United States Patent [19]

Taniguchi et al.

[11] Patent Number: 4,737,088

[45] Date of Patent: Apr. 12, 1988

[54] ROTARY COMPRESSOR WITH OIL RELIEF PASSAGE

[75] Inventors: Fumikazu Taniguchi, Kashiwara; Satoru Fujimoto, Sakai; Shigeki Hagiwara, Kawachinagano, all of Japan

[73] Assignee: Daikin Kogyo Co., Ltd., Osaka, Japan

[21] Appl. No.: 835,058

[22] Filed: Feb. 28, 1986

[30] Foreign Application Priority Data

Mar. 1, 1985 [JP] Japan ..... 60-30044
Mar. 1, 1985 [JP] Japan ..... 60-30045

[51] Int. Cl.[4] ..... F04C 18/356; F04C 29/02; F04C 29/04

[52] U.S. Cl. ..... 418/63; 418/75; 418/83; 418/85; 418/100; 418/189

[58] Field of Search ..... 418/63–67, 418/83, 85, 86, 100, 189, 180, 75, 76; 417/902

[56] References Cited

U.S. PATENT DOCUMENTS

| | | | |
|---|---|---|---|
| 1,970,033 | 8/1934 | Dennedy | 418/85 |
| 2,155,756 | 4/1939 | Firestone et al. | 418/63 |
| 2,300,005 | 10/1942 | Philipp | 417/902 |
| 4,537,567 | 8/1985 | Kawaguchi et al. | 418/63 |

FOREIGN PATENT DOCUMENTS

| | | | |
|---|---|---|---|
| 64739 | 11/1982 | European Pat. Off. | 418/85 |
| 2947479 | 5/1981 | Fed. Rep. of Germany | 418/63 |
| 45-40396 | 12/1970 | Japan | 418/100 |
| 55-98687 | 7/1980 | Japan | 418/189 |
| 58-66195 | 5/1983 | Japan . | |

*Primary Examiner*—John J. Vrablik
*Attorney, Agent, or Firm*—Cushman, Darby & Cushman

[57] ABSTRACT

A rotary compressor for helium gas has a cylinder defining a closed space therein, a rotor disposed in the closed space for eccentric rotary motion while making a sliding contact with the inner peripheral surface of the cylinder, and a blade slidably mounted on the cylinder and resiliently projected into the closed space for sliding contact with the rotor so as to divide the closed space into a suction chamber and a discharge chamber. The compressor further has an oil relief passage which is arranged to allow the discharge chamber to communicate with a space outside the discharge chamber in the final stage of the discharging stroke before the crank angle of the compressor reaches an angle corresponding to the position of a discharge port.

13 Claims, 8 Drawing Sheets

ROTARY COMPRESSOR WITH OIL RELIEF PASSAGE

BACKGROUND OF THE INVENTION

The present invention relates to a rotary compressor for compressing helium gas and, more particularly, to a rotary compressor having a relief passage for preventing undesirable liquid compression in the discharge chamber of the compressor.

Helium refrigerators which make use of helium as the refrigerant have been used for ultra-cryogenic uses because such refrigerators can easily generate cryogenic temperatures on the order of −200° C.

A compressor generally referred to as "rotary compressor", having an eccentric rotor rotatable in a closed space, is known as a compressor which is used in helium refrigerators. More specifically, this type of compressor has a cylinder which defines a closed space therein, a rotor adapted for eccentric rotation in the closed space while keeping a sliding contact with the inner peripheral surface of the cylinder, and a blade projecting into the closed space and contacting the rotor so as to separate the closed space into a suction chamber and a discharge chamber. In operation, the helium gas is drawn into the suction chamber the volume of which is progressively decreased so as to compress and then discharge the gas, as the eccentric rotation of the rotor advances.

On the other hand, the helium gas exhibits a drastic temperature rise when compressed, because it has a large adiabatic coefficient as compared with other types of refrigerant such as freon. For instance, when the compression is conducted at a compression ratio to the extent of 2 or 4, the helium gas drawn at about 30° C. exhibits a high temperature of 200° C. or higher when discharged. In consequence, the compressor which handles helium gas as the fluid to be compressed encounters problems or troubles such as reduction in the viscosity of lubricating oil due to high temperature, deterioration of the lubricating oil and so forth, with a result that the sliding parts of the compressor are not lubricated sufficiently. In the worst case, these sliding parts are damaged due to inferior lubrication.

To obviate these problems, it has been proposed to provide an oil injection mechanism in the compressor of the kind described. This oil injection mechanism is adapted to inject the lubricating oil into the drawn helium gas, after a cooling by a suitable means. This oil injection affords a remarkable reduction in the refrigerant temperature at the discharge side of the compressor. For instance, in the above-mentioned case where the helium gas sucked at about 30° C. is compressed at a compression ratio of 2 or 4, the temperature of the helium gas at the discharge side is advantageously decreased from 200° C. to 120° to 130° C.

The oil injection mechanism, which is effective in overcoming the problems concerning the temperature rise, produces another problem in that the rate of supply of the lubricating oil into the suction chamber of the compressor is increased impractically due to the injection of lubricating oil for the cooling purpose, and in that liquid oil compression inevitably takes place in the final stage of the discharge stroke. The liquid oil compression causes an abnormal pressure rise in the discharge chamber of the compressor, possibly resulting in a vibration and breakdown of movable parts such as the blade.

Some proposals have been made for preventing liquid oil compression in this type of compressor. For instance, Japanese Utility Model Application Laid-Open No. 66195/1983 discloses a compressor in which an axial recess is formed in the inner peripheral portion of the cylinder at a position between the discharge port and the blade so that the lubricating oil confined in the discharge chamber is received in the recess. This known arrangement is effective in the compressor which does not employ any oil injection system, e.g., the compressor which handles a different refrigerant such as freon. This arrangement, however, has only a limited capacity for holding the oil, and cannot prevent liquid oil compression when it is adopted in a compressor having the oil injection mechanism. Another measure for preventing the liquid oil compression disclosed in Japanese Patent Unexamined Publication No. 98687/1980 employs a circumferential groove formed in the inner peripheral surface of the cylinder and extending between the discharge port and the blade, whereby the oil confined in the discharge chamber is relieved through this groove. It is true that this arrangement can eliminate the risk of liquid oil compression in the discharge chamber. Unfortunately, however, this arrangement causes the high pressure oil introduced into the discharge port to act on a discharge valve, so as to abnormarily increase the velocity at which the valve member is brought into collision with the valve seat, causing a risk of breakdown of the discharge valve.

Thus, no practical measure has been established for effectively preventing the liquid oil compression in a rotary compressor having the oil injection mechanism.

SUMMARY OF THE INVENTION

Accordingly, an object of the invention is to provide a rotary compressor for helium gas, in which undesirable liquid oil compression is effectively prevented to assure a high reliability of the compressor.

To this end, the present invention is intended to relieve the oil in the discharge chamber to the outside thereof for preventing the liquid oil compression before the crank angle of the compressor reaches an angle corresponding to the discharge port in the final stage of the discharging stroke of the compressor. More specifically, according to the invention, there is provided a rotary compressor for helium gas of the type described above and having oil injection means, which comprises relief passage means arranged for allowing the discharge chamber to communicate with a space outside the discharge chamber in the final stage of the discharging stroke before the crank angle of the compressor reaches an angle corresponding to the opening position of the discharge port; whereby the oil remaining in the discharge chamber is relieved to the outside of the discharge chamber in the final stage of discharge stroke, thereby preventing liquid oil compression.

The above and other objects, features and advantages of the invention will become clear from the following description of the preferred embodiments when the same is read in conjunction with the accomanying drawings.

BRIEF DESCRIPTION OF THE PREFERRED EMBODIMENTS

DESCRIPTION OF THE PREFERRED EMBODIMENTS

Figure 1:
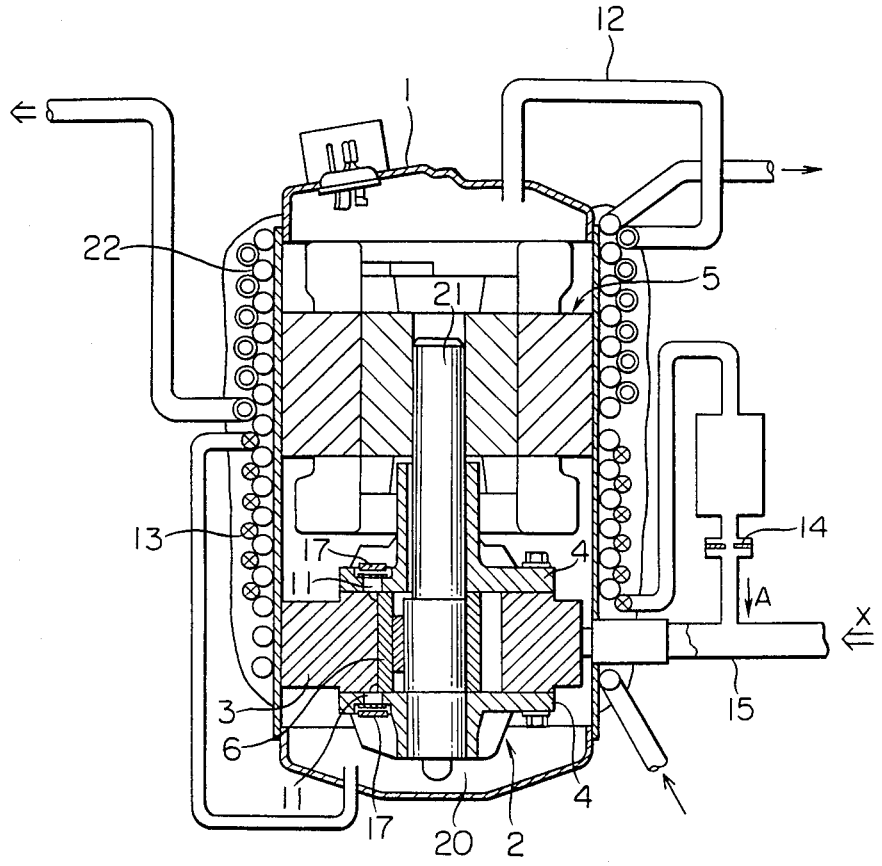
FIG. 1 is a vertical sectional view of a rotary compressor for helium gas according to an embodiment of the present invention.
Figure 2:
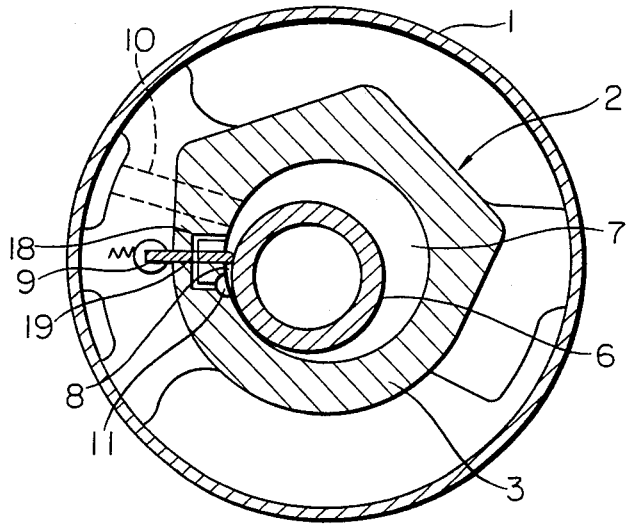
FIG. 2 is a cross-sectional view of the embodiment shown in FIG. 1.
Figure 3:
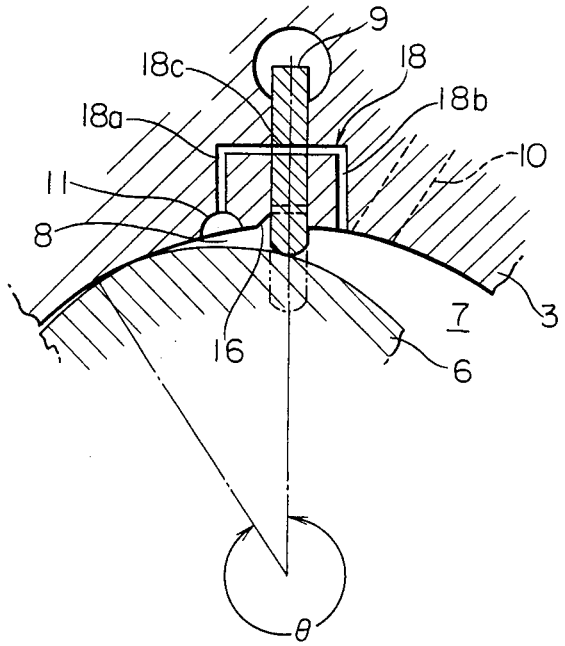
FIG. 3 is an enlarged view of an essential portion of the embodiment shown in FIG. 1.

FIGS. 1 to 3 show a first embodiment of the invention.

The general construction of the rotary compressor will be explained hereinunder with reference to FIG. 1. The compressor has a cylindrical casing 1 constituting a closed vessel, and an electric motor section 5 and a compressor section 2 which are received in upper and lower portions of the casing 1, respectively. The compressor section 2 and the electric motor section 5 are mounted in a frame provided in the casing 1. The compressor section 2 includes a cylinder 3, cylinder heads 4, 4 which close upper and lower ends of the cylinder so as to define a closed space in cooperation with the cylinder, and a rotor 6 which is rotatably accommodated in the closed space of the cylinder. Furthermore, as shown in FIG. 2, a blade 9 is provided in the compressor section 2, which contacts the rotor 6 so as to divide the closed space into two chambers, namely, a suction chamber 7 and a discharge chamber 8. The blade 9 is slidably received in a blade groove 19 formed in the cylinder wall and is biased resiliently so as to project into the closed space of the cylinder. Thus, the blade 9 is movable in accordance with the rotation of the rotor 6. On the other hand, the electric motor section 5 includes a motor which is drivingly connected to the rotor 6 of the compressor section through a shaft 21. The shaft 21 has a crank portion on which is mounted the rotor 6 so as to make an eccentic rotation along the inner peripheral surface of the cylinder.

As will be seen from FIG. 2, a suction port 10 is formed in the wall of the cylinder 3 so as to open into the suction chamber 7. A suction pipe 15 for introducing helium gas X is connected to the suction port 10. The suction pipe 15 is connected at its other end to a refrigeration cycle. Two discharge ports 11 are formed through the cylinder 3 and respective cylinder heads 4 to each open into the discharge chamber 8. The other end of each discharge port 11 communicates with the internal space of the casing 1 through a discharge valve 17. A discharge conduit 12 is connected to an upper portion of the casing 1 so as to introduce the high-pressure gas in the casing 1 to the refrigeration cycle. The bottom portion of the casing 1 constitutes an oil reservoir 20, and an oil conduit 13 is provided to connect the reservoir 20 with the suction pipe 15 through an orifice 14. The conduits 12 and 13 have respective tube portions wound in the forms of coils on the outer periphery of the casing 1, and a cooling pipe 22 is disposed in contact with these tube portions in heat-exchanging relation therewith. A cooling medium such as cooling water is circulated through the cooling pipe 22 so as to cool the helium gas in the discharge conduit 12 and a lubricating oil A in the oil conduit 13.

In operation of the compressor having the described construction, the helium gas X in the suction pipe 15 is drawn into the suction chamber 7 in accordance with the eccentric rotation of the rotor 6. The volume of the suction chamber 7 is progressively decreased so that the helium gas X is compressed in the suction chamber 7 (or discharge chamber 8). The thus compressed gas is discharged into the internal space of the casing 1 through the discharge ports 11 and the discharge valves, and is delivered through the conduit 12. As stated before, the gas is cooled while it passes through the conduit 12. On the other hand, the lubrication oil A stored in the oil reservoir 20 and kept in the atmosphere of high pressure reaches the orifice 14 through the conduit 13 while being cooled in the latter, and is injected into the sucked helium gas. The injected lubricating oil cools the helium gas and lubricates the sliding parts in the cylinder 3. Thereafter, a part of the lubricating oil in the form of liquid is returned to the oil reservoir 20 after being discharged from the discharge valves 17, while another part of the oil is suspended by the helium gas so as to be discharged into the internal space of the casing 1 and then liquefied and collected in the oil reservoir 20. The oil is then recirculated through the compressor for lubrication and cooling purposes. An oil separator may be provided in the discharge side of the compressor so as to separate lubricating oil still remaining in the compressed gas from the compressor. The oil separated by this oil separator is suitably returned to the compressor.

The construction and operation of the compressor described hereinbefore may be substantially the same as those of the known compressors, so that no further detailed explanation will be needed in this connection.

Figure 13:
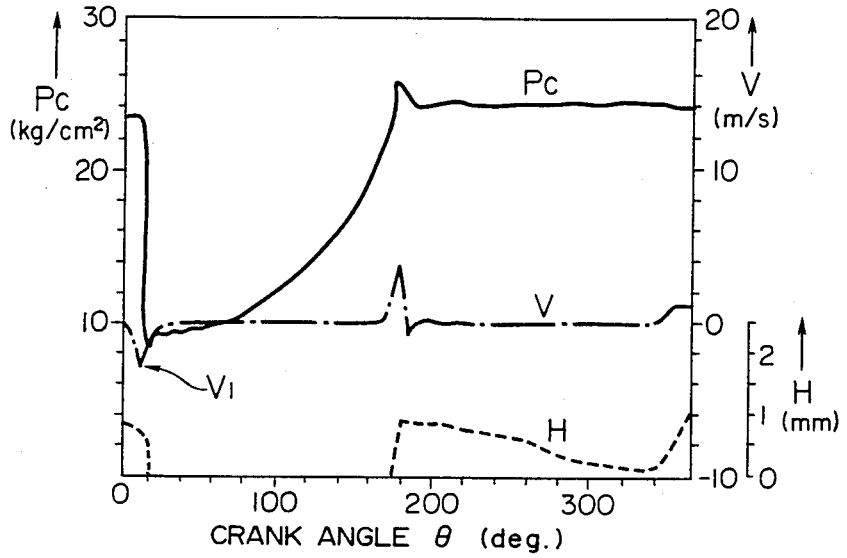
FIG. 13 (PRIOR ART)
FIG. 13 is a diagram showing the relationship between the internal pressure of a cylinder and the operation of a discharge valve as observed in a conventional rotary compressor.

In order to facilitate the understanding of the invention, an explanation will be made hereinunder as to the state of liquid oil compression in a conventional compressor, with specific reference to FIG. 13. FIG. 13 shows a graph in which the axis of abscissa represents the crank rotation angle $\theta$ (deg.) of the compressor, the axis of ordinate on the left side indicates the internal pressure Pc (kg/cm$^2$) of the cylinder, and the axis of ordinate on the right side indicates the velocity V (m/s) of movement of the valve member of a discharge valve, as well as the lift H (mm) thereof. As will be understood from this Figure, the internal pressure Pc rises as the crank rotation angle $\theta$ is increased during the operation of the compressor. The rise of the internal pressure Pc causes the discharge valve to open so as to commence the discharge of the compressed gas, at about 170 degrees in terms of crank angle in the illustrated example. Thereafter, the lift H of the discharge valve is decreased as the discharge of the compressed gas proceeds. Then, when the discharge of the compressed gas is almost finished, e.g., at about 340 degrees in terms of crank angle, the liquid oil compression begins within the discharge chamber. Therefore, as will be seen from FIG. 13, the discharge valve is drastically opened again in the period of 340 to 360 degrees in terms of crank angle, thereby relieving the pressurized oil. The pressure in the discharge port, however, is drastically lowered as the discharge port is brought into communication with the suction chamber of the low pressure, so that the discharge valve is closed again with the valve member striking the valve seat at a high velocity $V_1$, causing a possibility of a crack in the valve member or the valve seat.

In view of the above-described shortcoming of the prior art, the present invention is intended to relieve the oil in the discharge chamber to the outside thereof before it is compressed in the final stage of the discharge stroke, thereby avoiding the undesirable liquid oil compression in the discharge chamber. To this end, in the first embodiment of the invention shown in FIG. 2, at least one oil relief passage 18 is formed through the cylinder 3 and the blade 9, so as to allow the discharge chamber 8 to communicate with the suction chamber 7 in the final stage of the discharge stroke.

As shown in detail in FIG. 3, the oil relief passage 18 is composed of a first passage 18*a* and a second passage 18*b* formed in the cylinder 3 on both sides of the blade 9, and a third passage 18*c* which is formed in the blade 9 so as to penetrate the same in the thicknesswise direction thereof. The first passage 18*a* opens in the discharge chamber 8, more particularly in one of the discharge ports 11, while the second passage 18*b* opens in the suction chamber 7. In the described embodiment, the third passage 18*c* in the blade is so located that it provides a communication between the first passage 18*a* and the second passage 18*b* at the crank rotation angle $\theta=330\pm5°$. This third passage 18*c* has to be positioned so as not to allow a direct communication between the discharge chamber 8 and the suction chamber 7, even when the blade 9 is fully projected into the closed space of the cylinder. A reference numeral 16 denotes an oil receiving recess which is formed in the portion of the cylinder 3 adjacent the blade 9. This oil receiving recess is substantially the same as that in the prior art.

The operation of the oil relief passage 18 is as follows.

Before the rotor 6 reaches the rotational position of $\theta=330\pm5°$, the first and the second passages 18*a* and 18*b* in the cylinder are isolated from each other by the blade 9. Accordingly, the compressed helium gas is discharged into the casing 1 from the discharge ports 11. In the final stage of the discharge stroke at which the discharge of the compressed helium gas has been almost finished, e.g., at $\theta=330\pm5°$ in terms of the crank angle in the embodiment, the first passage 18*a* and the second passage 18*b* in the cylinder are brought into communication with each other through the third passage 18*c* in the blade, whereby the oil remaining in the discharge chamber 8 is relieved into the suction chamber 7 through the discharge port 11 and the oil relief passage 18. In consequence, the risk of liquid oil compression at the final stage of the discharge stroke is avoided and the velocity at which the valve member of each discharge valve 17 collides with the valve seat can be reduced remarkably.

Different embodiments of the invention will be described hereinunder with reference to FIGS. 4 to 12. These different embodiments have an identical basic construction of the compressor with each other, except the construction or arrangement of the oil relief passage. Therefore, in FIGS. 4 to 12, the same or like numerals as those used in FIGS. 1 to 3 are used to denote the same or like parts of the compressors, and description of the basic construction of the compressor is omitted in the following description of the different embodiments.

Figure 4:
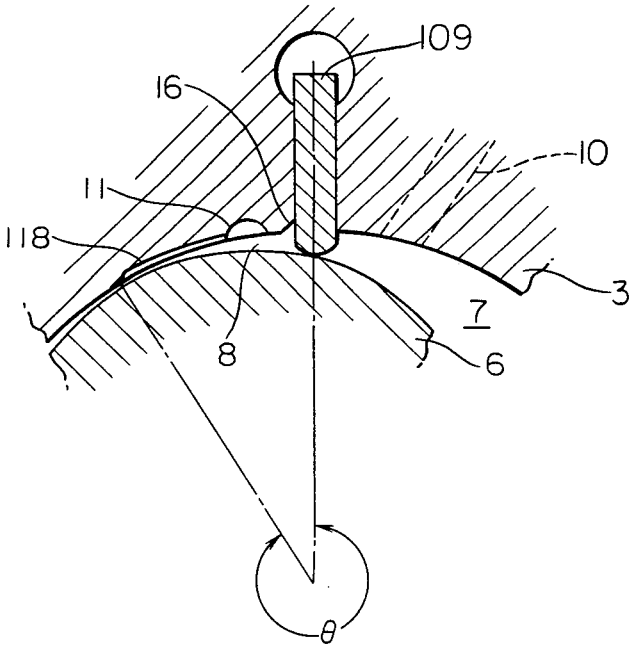
FIG. 4 is an enlarged view similar to FIG. 3, showing an essential portion of another embodiment of the invention.
Figure 5:
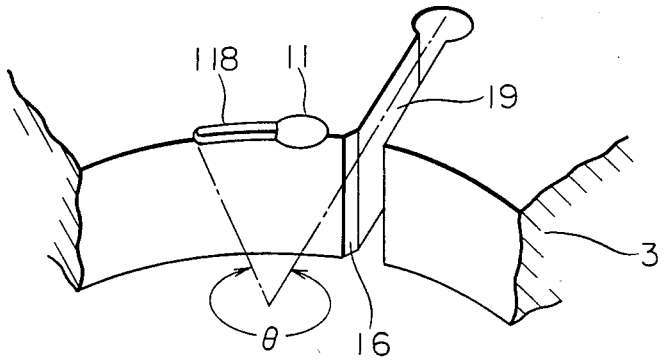
FIG. 5 is a perspective view of the cylinder incorporated in the arrangement of FIG. 4.

FIGS. 4 and 5 show a second embodiment of the invention, in which the oil relief passage is constituted by a circumferential groove 118 formed in the edge portion of the inner peripheral surface of the cylinder 3 so as to extend between the position of $\theta=330\pm5°$ in terms of the crank angle and the discharge port 11. In this embodiment, when the rotor 6 has been rotated beyond the position of $\theta=330\pm5°$, the end of the groove 118 is opened in the suction chamber 7, so that the oil remaining in the discharge chamber 8 is relieved into the suction chamber 7 through the discharge port 11 and the groove 118.

Figure 6:
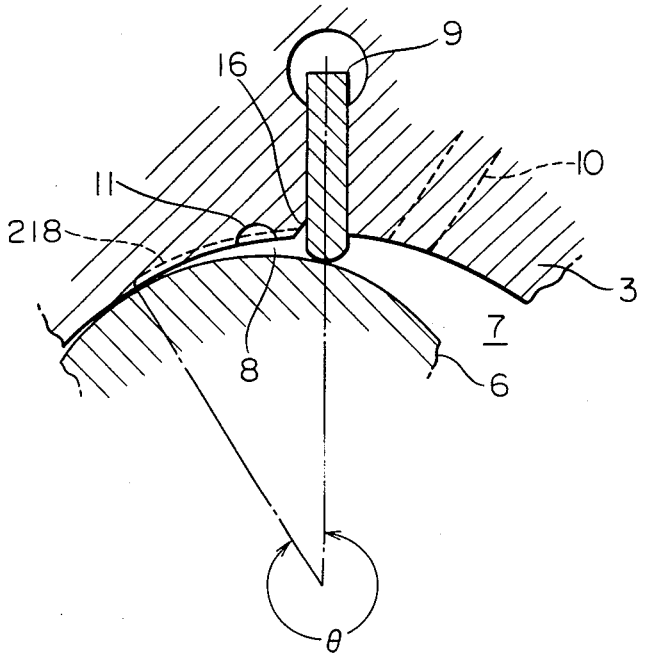
FIG. 6 is an enlarged view of an essential portion of still another embodiment of the invention.
Figure 7:
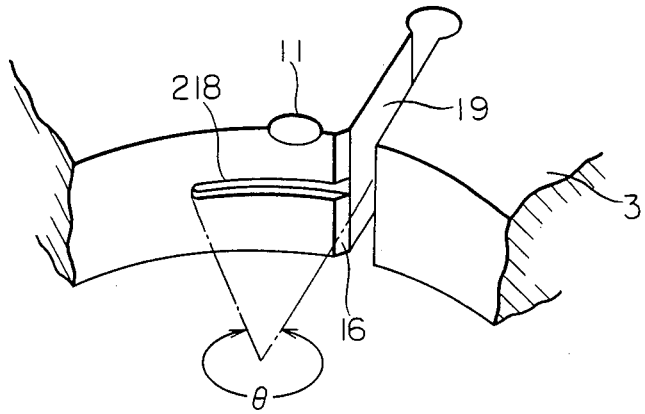
FIG. 7 is a perspective view of the cylinder incorporated in the arrangement of FIG. 6.

FIGS. 6 and 7 show a third embodiment of the invention, wherein the oil relief passage is constituted by a groove 218 which is formed in the inner peripheral surface of the cylinder 3 at a thicknesswise intermediate portion thereof so as to extend from the position of $\theta=330\pm5°$ and the oil receiving recess 16 adjacent the blade 9. In operation, when the rotor 6 has been rotated beyond the position $\theta=330\pm5°$ in terms of the crank angle, one end of the groove 218 is opened in the suction chamber 7 so that the oil remaining in the discharge chamber 8 is discharged into the suction chamber 7 through the oil receiving recess 16 and the groove 218.

Figure 8:
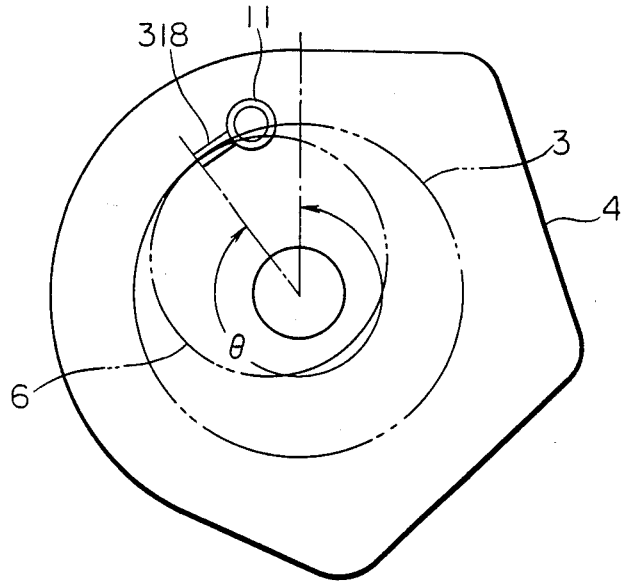
FIG. 8 is a plan view showing the interior of the cylinder head used in a rotary compressor of a further embodiment of the invention.

FIG. 8 shows a fourth embodiment of the invention. In this embodiment, the oil relief passage is constituted by a groove 318 which is formed in the inner surface of the cylinder head 4 so as to extend along the contour of the inner peripheral surface of the cylinder 3 from the position of $\theta=330\pm5°$ in terms of the crank angle to the position of the discharge port 11. According to the embodiment, the oil relief passage plays the same role as that in the embodiment shown in FIGS. 4 and 5.

Figure 9:
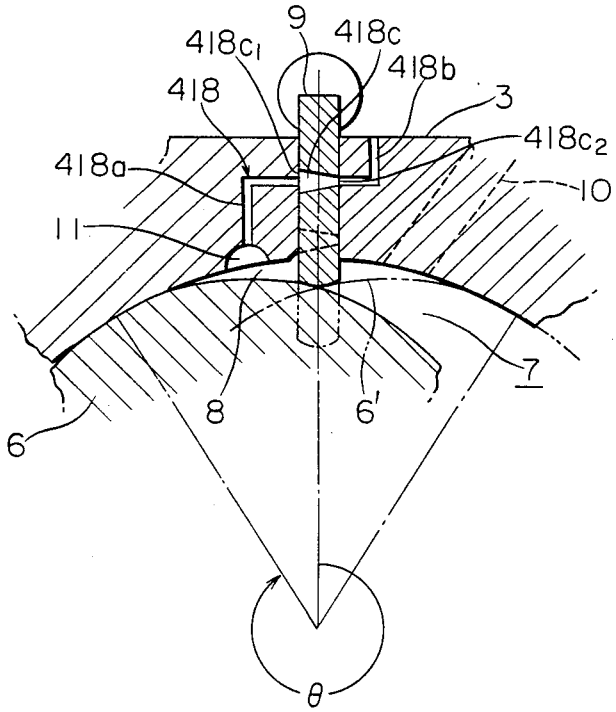
FIG. 9 is an enlarged view of an essential portion of a still further embodiment of the invention.

FIG. 9 shows a fifth embodiment, in which an oil relief passage 418 is formed through the cylinder 3 and the blade 9 so as to provide communication between the discharge chamber 8 and the internal space of the casing 1 in the final stage of the discharge stroke of the compressor.

This oil relief passage 418 is constituted by a first passage 418*a* and a second passage 418*b* which are formed in the cylinder 3 on both sides of the blade 9, and a third passage 418*c* which is formed in the blade 9 so as to penetrate the same in the thicknesswise direction thereof. The first passage 418*a* opens in the discharge chamber 8, more particularly in one of the discharge ports 11, while the second passage 418*b* opens in the internal space of the casing 1. The third passage 418*c* in the blade is located so as to provide communication between the first passage 418*a* and the second passage 418*b* when the rotor 6 is at a rotational position which is expressed by $\theta=330\pm5°$ in terms of the crank angle. The third passage 418*c* is formed in such a tapered shape that its end 418$c_1$ to be opened to the first passage 418*a* has a diameter greater than the other end 418$c_2$ to be opened to the second passage 418*b*. The third passage 418*c* in the blade, therefore, has a function for preventing reversing of the helium gas or the oil from the internal space of the casing 1 into the discharge chamber 8.

The operation of this embodiment is substantially the same as that of the embodiment shown in FIGS. 2 and 3 except that the oil remaining in the discharge chamber 8 is discharged into the internal space of the casing 1. It will be understood that the oil relief passage 418 is opened also when the rotor is in the position of $\theta=30\pm5°$ as indicated by a numeral 6' in FIG. 9. In this state, however, the reversing of the helium gas or oil from the internal space of the casing 1 of high pressure to the discharge chamber 8 is negligibly small by virtue of the checking function of the third passage 418*c* formed in the blade.

Figure 10:
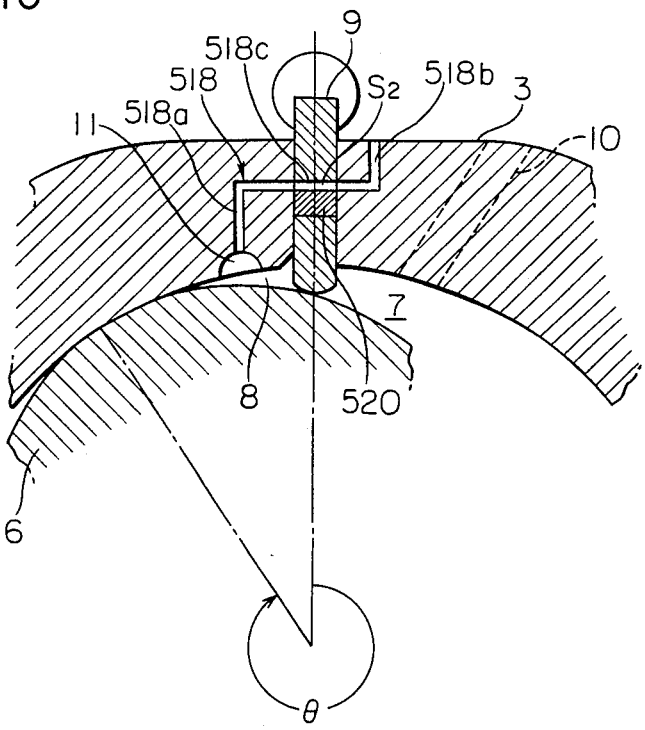
FIG. 10 is an enlarged view of still further embodiment of the invention.
Figure 11:
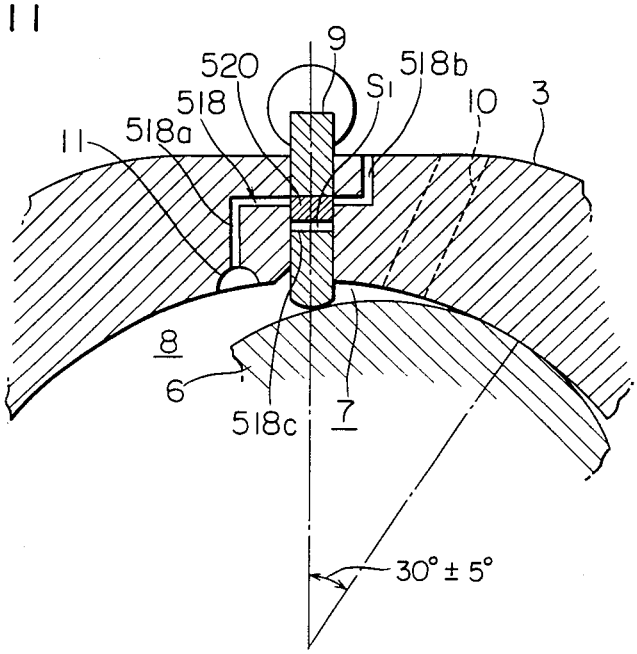
FIG. 11 is an enlarged view of an essential portion of the embodiment shown in FIG. 10 with the blade and rotor in respective different positions from those shown in FIG. 10.

FIGS. 10 and 11 show a sixth embodiment of the invention. In this embodiment, the oil relief passage 518 is constituted by first and second passages 518*a* and 518*b* formed in the cylinder and a third passage 518*c* formed in the blade, as in the case of the fifth embodiment. In the sixth embodiment, however, the passage 518*c* is formed as an elongated hole which has rectangular cross-section and a width greater than that of the first and second passages 518*a*, 518*b* in the direction of sliding of the blade 9. A valve member 520 made of such a material as ethylene tetrafluoride is slidably disposed in the elongated passage 518*c*. The valve member 520 is so sized that it makes a frictional sliding engagement with the walls of the groove 19 which slidingly receives the blade 9.

In the operation of this embodiment, the blade 9 moves inwardly of the cylinder 3 when the rotor position is within the range of 0° and 180° in terms of the crank angle as shown in FIG. 11. In this state, the valve member 520 is moved together with the blade 9 in such a manner as to leave a gap $S_1$ on the radially inner side thereof, so that the oil relief passage 518 is interrupted by the blade 9 and the valve member 520. However, when the rotor position is within the range between 180° and 360° in terms of the crank angle, the blade 9 slides outwardly of the cylinder 3 as shown in FIG. 10. In this case, a gap $S_2$ is formed on the radially outer side of the valve member 520 which moves together with the blade 9. In this embodiment, the position of the third passage 518*c* is so determined that the gap $S_2$ provides communication between the first and second passages 518*a* and 518*b* when the rotor is at the position expressed by $\theta=330\pm5°$ in terms of the crank angle. As a result, the oil relief passage 518 is opened so that the oil remaining in the discharge chamber 8 is relieved into the internal space of the casing 1 through the discharge port 11 and the passage 518. Thus, the valve member 520 is moved following the sliding movement of the blade 9 such as to open and close the oil relief passage, thus serving as a check valve.

Figure 12:
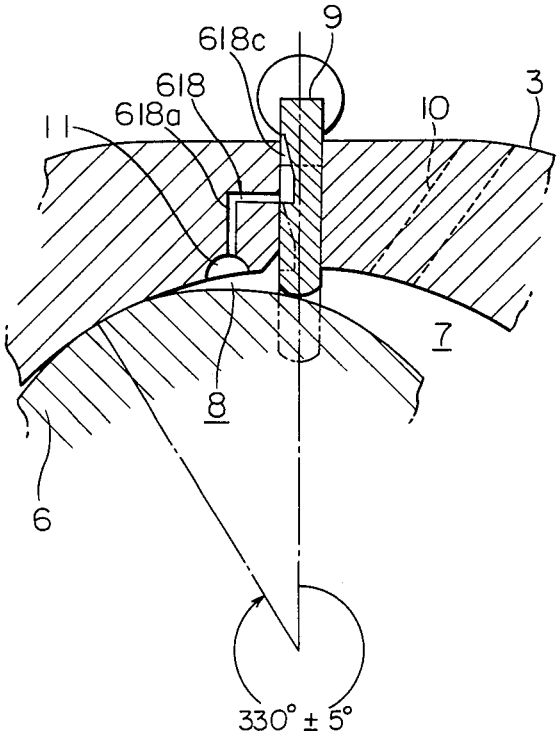
FIG. 12 is an enlarged view of an essential portion of still another embodiment of the invention.

FIG. 12 shows a seventh embodiment of the invention, wherein the oil relief passage 618 is constituted by a passage 618*a* formed in the cylinder so as to open in the discharge chamber 8, more specifically in one of the discharge ports 11, and a passage 618*c* constituted by a groove formed in the side surface of the blade 9 adjacent the discharge chamber. The passage 618*c* in the blade is so sized and positioned that it allows the passage 618*a* in the cylinder to communicate with the internal space of the casing 1 when the rotor 6 is in the position expressed by $\theta=330\pm5°$ in terms of crank angle. Namely, when the rotor 6 has been rotated beyond the position expressed by $\theta=330\pm5°$ in terms of crank angle, the outer end of the passage 618*c* is opened in the interior of the casing 1, so that the oil remaining in the discharge chamber 8 is relieved into the internal space of the casing 1 through the discharge port 11 and the oil relief passage 618 before the liquid oil compression is caused. In this embodiment, the passage 618*a* in the cylinder communicates with the internal space of the casing 1 through the passage 618*c* formed in the side surface of the blade 9. With this arrangment, it is possible to eliminate any risk of direct communication between the discharge chamber 8 and the suction chamber 7 during sliding of the blade 9, regardless of the position where the passage 618*c* is formed in the blade 9.

Figure 14:
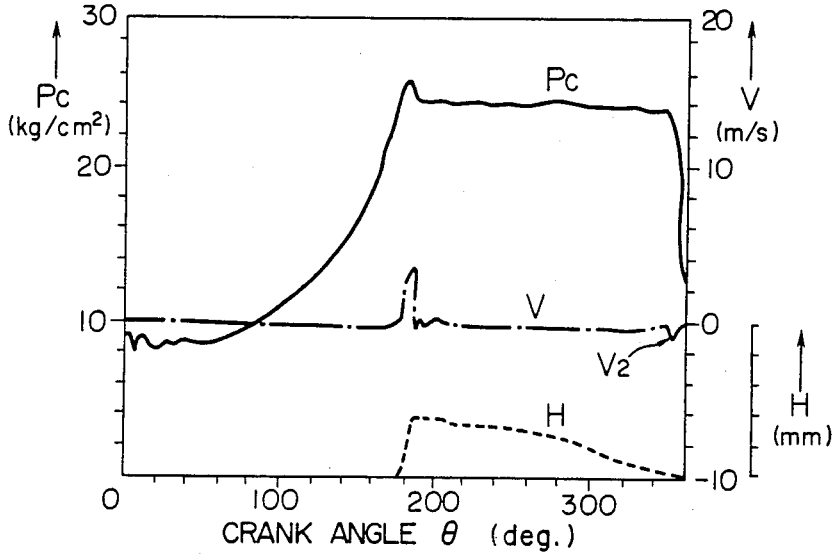
FIG. 14 is a diagram showing the relationship between the internal pressure of a cylinder and the operation of a discharge valve as observed in a rotary compressor according to the invention.

FIG. 14 is a graph similar to that in FIG. 13, showing the relationship between the internal pressure of the cylinder and the behaviour of the discharge valve as observed in the rotary compressor of the invention. As will be seen from this Figure, the lubricating oil remaining in the compression chamber is relieved in the final stage of the discharge stroke, so that the risk of liquid oil compression is avoided. Accordingly, the internal pressure Pc of the cylinder decreases comparatively gently, when the rotor position is within the range between 340° and 360° in terms of the crank angle. In consequence, the velocity $V_2$ at which the valve member of the discharge valve collides with the valve seat is drastically decreased as compared with $V_1$ of the conventional compressor shown in FIG. 13. As a result, the risk of troubles such as valve cracking is completely eliminated and the reliability of the compressor is improved advantageously. The result shown in FIG. 14 has been obtained with the embodiment shown in FIG. 8. It is to be understood, however, similar effects for preventing the liquid oil compression are achieveable by other embodiments, although there may be slight differences in the operation characteristics.

Although the invention has been described through its specific forms, it will be clear to those skilled in the art that the described embodiments are only illustrative and various changes and modifications may be imparted thereto without departing from the scope of the invention which is limited solely by the appended claims. For instance, although the oil relief passages of the embodiments have been described to open at the rotor position of $\theta=330\pm5°$ in terms of crank angle, this position is not exclusive and may be suitably selected in accordance with factors such as the position of the discharge port. When the above-mentioned position of $\theta=330\pm5°$ in terms of crank angle is preferred, the effect of the invention is not substantially impaired even when the position at which the oil relief passage is opened is selected to fall within the range of $\theta=330\pm10°$ in terms of crank angle.

What is claimed is:

1. A rotary compressor for helium gas comprising:

a cylinder; a pair of cylinder heads covering both open ends of said cylinder so as to define a closed space in said cylinder;

a rotor disposed in said closed space for an eccentric rotary motion while making a sliding contact with an inner peripheral surface of said cylinder; a blade slidably mounted on said cylinder and resiliently projected into said closed space for sliding contact with said rotor so as to divide said closed space into a suction chamber and a discharge chamber; suction passage means communicating with said suction chamber for introducing into said suction chamber a helium gas with an oil injected thereinto for lubrication and cooling; discharge passage means having at least one discharge port opening into said discharge chamber so as to discharge compressed gas; and oil relief passage means for allowing said discharge chamber to begin to communicate with a space outside said discharge chamber when a position of said rotor falls within a range of 330±5 degrees in terms of crank angle of said compressor, whereby the oil remaining in said discharge chamber is relieved to the outside of said discharge chamber in final stage of a discharge stroke before the crank angle of said compressor reaches an angle corresponding to a position of said discharge port, thereby preventing liquid oil compression.

2. A rotary compressor according to claim 1, wherein said oil relief passage means allows said discharge chamber to communicate with said suction chamber in said cylinder.

3. A rotary compressor according to claim 1, further comprising a hermetic casing for accommodating the constituent parts of said compressor, said discharge passage means being provided so as to deliver the compressed gas to the outside of said casing through an internal space of said casing between the wall of said casing and said constituent parts, said discharge chamber being communicated with said internal space of said casing through said oil relief passage means.

4. A rotary compressor according to claim 2, wherein said oil relief passage means includes first and second passages formed in said cylinder on both sides of said blade and communicating at their one ends within said discharge chamber and said suction chamber, respectively, and a third passage formed through said blade at a position where said third passage is brought into communication with other ends of said first and second passages in the final stage of the discharging stroke as said blade is slid in accordance with rotation of said rotor.

5. A rotary compressor according to claim 2, wherein said discharge port opens in an edge of the inner peripheral surface of said cylinder, and said oil relief passage means includes a groove which extends along said edge of the inner peripheral surface of said cylinder from the opening of said discharge port in a direction counter to a direction of rotation of said rotor.

6. A rotary compressor according to claim 2, wherein said oil relief passage means includes a groove formed in the inner peripheral surface of said cylinder at a thicknesswise intermediate portion of said cylinder and extending in a direction counter to a direction of rotation of said rotor from a position where said blade is provided.

7. A rotary compressor according to claim 2, wherein said oil relief passage means includes a groove which is formed in an inner surface of one of said cylinder heads facing said closed space in said cylinder and said discharge port to extend in a direction counter to a direction of rotation of said rotor from a position of said discharge port.

8. A rotary compressor according to claim 3, wherein said oil relief passage means includes first and second passages formed in said cylinder on both sides of said blade and having one of the ends communicating with said discharge chamber and said internal space of said casing, respectively, and a third passage formed through said blade at a position where said third passage is brought into communication with the other ends of said first and second passages in the final stage of the discharging stroke as said blade is slid in accordance with the rotation of said rotor.

9. A rotary compressor according to claim 8, wherein said third passage formed in said blade has a reversing flow prevention mechanism for preventing a discharged fluid from said internal space of said casing back into said discharge chamber.

10. A rotary compressor according to claim 9, wherein said reversing flow prevention mechanism is constituted by said third passage which is tapered to have smaller opening diameter at its end adjacent said second passage than at its other end adjacent said first passage, so that a reversing flow of the fluid from said internal space of said casing back to said discharge chamber is prevented.

11. A rotary compressor according to claim 9, wherein said reversing flow prevention mechanism includes said third passage of said oil relief passage means, an elongated hole formed in said blade so as to extend in a direction of sliding of said blade over a length greater than a width of said third passage, and a valve member which is received in said elongated hole so as to leave a space corresponding to said third passage, said valve member makes sliding contact at its both end surfaces with adjacent surfaces of said cylinder so as to maintain its position due to frictional engagement with these surfaces of said cylinder when a direction of sliding of said blade is switched in accordance with the rotation of said rotor.

12. A rotary compressor according to claim 3, wherein said oil relief passage means includes a first passage formed in said cylinder so as to extend from one end opening thereof in said discharge chamber to one side surface of said blade, and a second passage formed in said one side surface of said blade to extend in a direction of sliding of said blade, said second passage being positioned so that, as said blade is moved in accordance with the rotation of said rotor, said second passage provides a communication between the other end of said first passage and the internal space of said casing in the final stage of the discharging stroke.

13. A rotary compressor for compressing helium gas comprising:

a compressor section including a cylinder, a pair of cylinder heads covering both open ends of said cylinder to define a closed space in said cylinder, a rotor disposed in said closed space for eccentric rotation therein while making sliding contact with an inner peripheral surface of said cylinder, and a blade slidably mounted in said cylinder and resiliently projected into said closed space so as to contact said rotor thereby dividing said closed space in said cylinder into a suction chamber and a discharge chamber;

an electric motor sector drivingly connected to said compressor section through a driving shaft which extends through one of said cylinder heads for driving said rotor;

a hermetic casing accomodating said compressor section and said electric motor section;

suction passage means leading to said suction chamber in said compressor section through said casing and said cylinder for introducing said helium gas;

discharge passage means including at least one discharge port opening into said discharge port for discharging a compressed gas into an internal space of said casing, and a pipe line extending from said internal space of said casing to an outside of said casing for delivery of the compressed gas;

oil recirculating means including a pipe line providing communication between a bottom portion of said casing and said suction passage means for sucking an oil in said bottom of said casing and injecting said oil into the drawn helium gas for the purpose of cooling of said helium gas and lubrication of said compressor;

cooling means having a pipe line which is arranged in a heat-exchanging relation with said pipe lines of said discharge passage means and said oil recirculating means so as to cool a discharged gas and the oil to be injected; and oil relief groove means provided in an inner surface of one of said cylinder heads facing said closed space in said cylinder and said discharge port, said groove extending along the inner periphery of said cylinder in a direction counter to a direction of rotation of said rotor from a position corresponding to said discharge port so as to begin to provide communication between said discharge chamber and said suction chamber when a position of said rotor falls within a range of 300±5 degrees in terms of crank angle of said compressor, whereby the oil remaining in said discharge chamber is relieved to the outside of the said discharge chamber in final stage of a discharge stoke thereby preventing liquid oil compression.

* * * * *